US005626233A

United States Patent [19]

Wells, II

[11] Patent Number: 5,626,233

[45] Date of Patent: May 6, 1997

[54] EDDY CURRENT SEPARATOR

[75] Inventor: Rano R. Wells, II, Franklin, Wis.

[73] Assignee: Venturedyne, Ltd., Milwaukee, Wis.

[21] Appl. No.: 399,815

[22] Filed: Mar. 7, 1995

[51] Int. Cl.[6] ..... B03C 1/00

[52] U.S. Cl. ..... 209/219; 209/636

[58] Field of Search ..... 209/212, 213, 209/217, 218, 219, 226, 227, 636

[56] References Cited

U.S. PATENT DOCUMENTS

| | | | |
|---|---|---|---|
| 2,719,630 | 10/1955 | Injeski, Jr. | 209/219 |
| 2,992,733 | 7/1961 | Buus et al. | 209/219 |
| 4,031,004 | 6/1977 | Sommer, Jr. | 209/212 |
| 4,069,145 | 1/1978 | Sommer, Jr. | 209/212 |
| 4,668,381 | 5/1987 | Julius | 209/39 |
| 5,207,330 | 5/1993 | Siesco, Jr. | 209/219 |
| 5,236,091 | 8/1993 | Kauppila et al. | 209/636 X |

FOREIGN PATENT DOCUMENTS

| | | | |
|---|---|---|---|
| 6063443 | 3/1994 | Japan | 209/219 |
| 6246183 | 9/1994 | Japan | 209/219 |

OTHER PUBLICATIONS

Elektromagnetbau Company of Cologne, Germany—Technical brochure dated Oct., 1988—4 pages.

Eriez Magnetic of Erie, Pennsylvania—Technical brochure dated Jul., 1991—4 pages.

"Eddy–Current Separator Aids Recycling" from *Machine Design* magazine dated Oct. 24, 1991—5 pages.

Osborne Engineering, Inc. of Tulsa, Oklahoma—Technical brochure estimated date Dec., 1989—2 pages.

Devcon Company of Danvers, Masschusetts—brochure dated Apr., 1992—4 pages.

*Primary Examiner*—William E. Terrell
*Assistant Examiner*—Tuan Nguyen
*Attorney, Agent, or Firm*—Jansson & Shupe, Ltd.

[57] ABSTRACT

The disclosed eddy-current separator has several new features. One includes a magnet assembly which is metal-sleeved for protecting the magnets from impact by particles or objects piercing the waste-carrying conveyor belt with which the separator is used. A low-rotating-speed epoxy-layered shell surrounds the sleeve for additional protection. A conveying extension carries ferrous "fines" from the conveyor into the receptacle used to collect waste from which non-ferrous material has been separated. Such extension permits such fines to be under the substantial influence of the magnet assembly over an arc well less than 180°. The conveyor belt uses relatively-closely-spaced cleats of reduced height to reduce the "loading" of an individual cleat with potentially-piercing ferrous fines. A two pole magnet assembly may be used and/or a magnet assembly in which the magnet pole faces are curved for air gap reduction.

15 Claims, 6 Drawing Sheets

FIG. 1
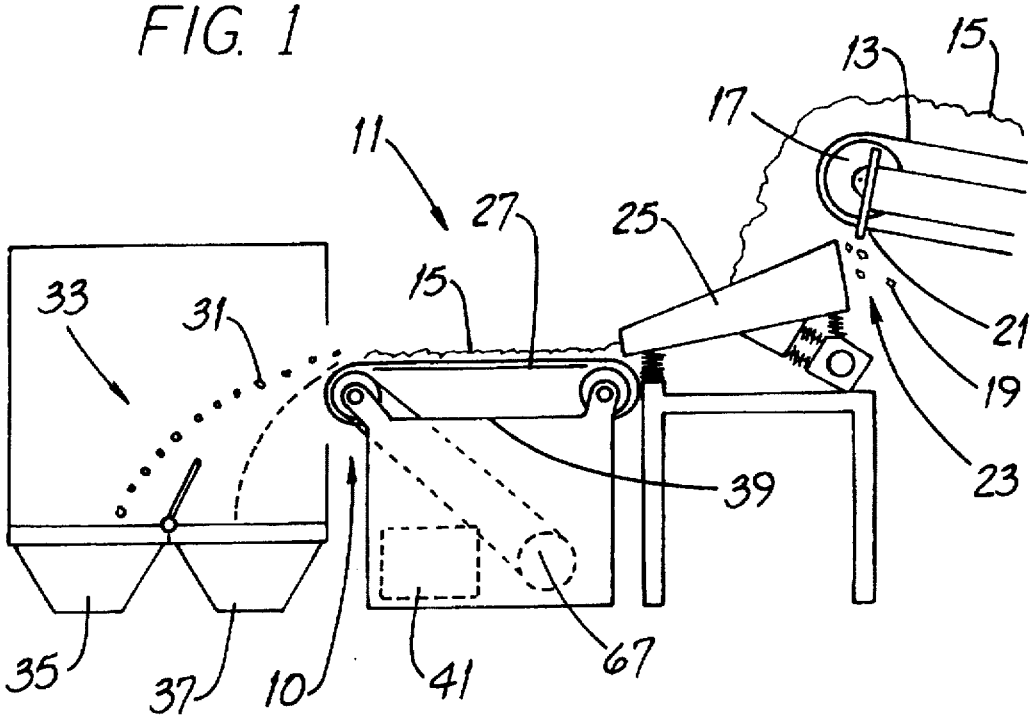
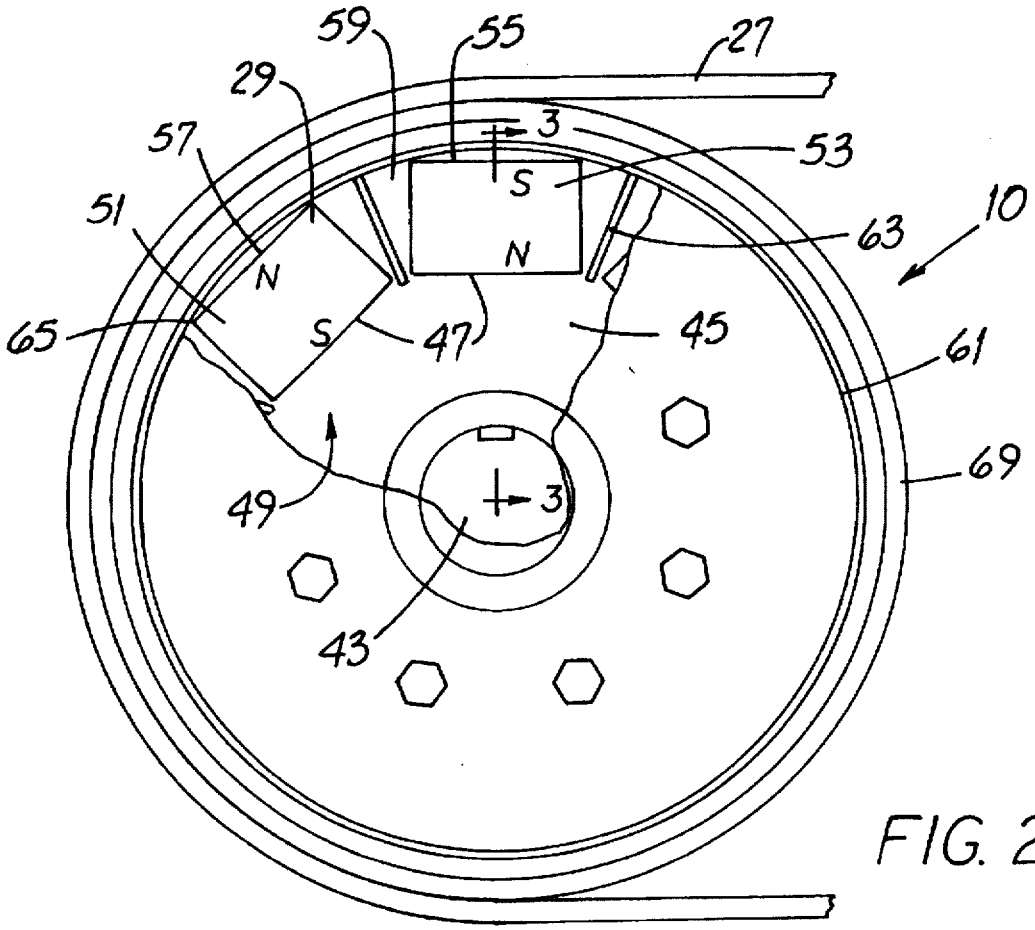
FIG. 2

EDDY CURRENT SEPARATOR

FIELD OF THE INVENTION

This invention relates generally to classifying, separating and sorting of solids and, more particularly, to the use of magnetic fields for such purposes.

BACKGROUND OF THE INVENTION

Magnets and magnetic fields have long been used for separating ferrous (iron-containing) metals from bulk waste or from a conveyed waste stream. An example of such a use may be found at automotive shredding facilities where scrap autos are disposed of, often at the rate of 300–400 autos per day.

When disposing of a scrap auto using a shredder, common practice is to remove the tires, battery and the fluids, e.g., anti-freeze and motor oil, and break up or "reduce" the remainder in a shredder, hammermill or the like. The auto being reduced into much smaller pieces of scrap will include both ferrous and non-ferrous metal constituents (such as steel and aluminum, respectively) as well as non-metal constituents such as plastics and fabric. After such reduction, the scrap is fed to a conveyor belt, the discharge end of which is equipped with a drum-like magnetic separator for "first-stage" separation. Ferrous metal "follows" the contour of the separator drum through about a 180° path and falls from the conveyor belt when such belt leaves the separator drum. The remaining scrap is "projected" somewhat forward of the separator by the moving conveyor belt to a "downstream" second conveyor belt for subsequent removal of the non-ferrous metal from the non-metal constituents of the remaining waste stream.

Such non-ferrous metal constituents, e.g, aluminum, are removed by using what is known as an eddy current separator. Eddy current separators are discussed in U.S. Pat. Nos. 4,031,004 (Sommer, Jr. et al.); 4,069,145 (Sommer, Jr. et al.) and 4,668,381 (Julius).

A conventional eddy current separator has a number of relatively-small magnets arranged to form a drum-like assembly. Such assembly rotates at a speed of 1500 RPM to 3000 RPM and as the magnetic fields produced by such magnets "sweep across" the non-ferrous metal, a circulating electrical current or "eddy current" is induced in such metal.

Like all electrical currents, such eddy current produces a magnetic field having a polarity which is the same as that of the magnet which induced such current. Since like magnetic poles repel one another, the scrap metal piece is repelled and projected away from the conveyor belt along a fairly-predictable trajectory to a receptacle spaced somewhat away from the eddy current separator.

The remaining non-metal constituents (which consist largely of "fluff" from shredded upholstery) fall from the end of the conveyor belt to a receptacle adjacent to such separator where they are collected for removal. Eddy current separators are sometimes referred to as "flinger" separators since they literally fling non-ferrous metal pieces away from the conveyor belt.

And eddy current separators are not only used for separating non-ferrous metal from shredded autos. Such separators have great utility in separating non-ferrous metals, particularly aluminum beverage cans, from municipal waste streams. With the advent of "curbside" segregation of recyclable materials such as plastic beverage containers, tin-coated steel cans, glass and aluminum cans, eddy current separators are very useful to remove aluminum cans from such recyclable materials after the ferrous materials have been removed.

While known eddy current separators and ancillary equipment have been generally satisfactory, there are a number of problems that, until the invention, defied solution. One involves the eddy current magnet assembly which can be impacted by metal pieces piercing the conveyor belt with which the separator is operating. The magnet assembly is made of expensive and very-brittle (almost glass-like) rare earth magnets and represents a major portion, i.e., 50% or more, of the value of the separator.

To have a better understanding of this problem, it is helpful to appreciate two facts. One is that small vagrant ferrous pieces may remain in the waste stream even after first-stage "ferrous product" magnetic separation. The second is that because of the high speed at which the eddy current separator rotates, such vagrant ferrous pieces spin on the conveyor surface at high speed. These spinning pieces can (and often do) "drill" a hole in the conveyor belt, pierce the composite shell supporting the belt and fly into the separator magnets and fracture them. Resulting replacement cost is high and downtime is expensive.

One known magnet assembly is wrapped with resin-treated carbon filament threads. This arrangement is for retaining the magnets against centrifugal force and offers essentially no protection against projectile-like pieces which pierce the conveyor belt and the shell.

Another problem of known eddy current separators involves the durability of the above-mentioned cylindrical composite shell spaced from and surrounding the eddy current magnet assembly. Such shell contacts and supports the conveyor belt and rotates at relatively low speed. Conventional shells are made of fiberglass and do little to protect the magnet assembly spinning within. And if a ferrous particle lodges on the shell between the belt and such shell, the particle (which will spin for the reasons described above) can cut a groove in the shell. In an only-somewhat-more-extreme case, such a particle can sever the shell into two pieces.

Still another problem of known eddy current separators arises from the above-mentioned small ferrous pieces and dust-like "fines" remaining in the waste stream after first-stage separation. Such particles are not removed by the eddy current separator but, rather, tend to cling to the conveyor belt and fall from such belt at a point behind the separator. Therefore, a separate collection receptacle must be provided. Until the invention, there was no way to collect such particles together with the other non-metal constituents, e.g., auto upholstery "fluff," in the same receptacle.

Another problem arises from the conveyor belts used with conventional separators. Such belts have regularly-spaced, laterally-disposed cleats on the belt surface. Such cleats project well above the belt surface and because of their height, significant quantities of very small ferrous particles tend to collect on the cleats and, particularly, at the junction of the cleat edge and the belt. As noted above, such particles spin wildly when passing near the rotating separator magnet assembly and bore holes into and through the conveyor belt.

Yet another problem involves the magnetic structure of the magnet assembly itself. It is known that the magnetic effect between a magnet and, e.g., a non-ferrous piece of metal diminishes by the square of the distance between the magnet and the metal piece. And conventional magnets have flat pole faces. These facts suggest that the preferred way to construct a magnet assembly is to use a relatively large number of smaller magnets. Since the chord length of the pole face of each magnet is relatively short, such magnets can be positioned closer to the surrounding composite shell and, thus, closer to the conveyor belt. Such approach is used in known assemblies.

(This somewhat-difficult-to-visualize concept might be better understood by considering placing the ends of a straight stick chord-like against the inside surface of a barrel. The shorter the stick, the closer the stick center to such inside surface.)

The otherwise-diminuted strength of the magnetic field resulting from using small magnets is understood by designers of such magnet assemblies to be compensated by the larger number of magnets. But tests demonstrate that while field strength at the surface of the conveyor belt may be adequate, such field strength drops off rapidly at points progressively farther away from such belt.

Further, known magnet assemblies support the individual magnets on what is sometimes referred to as a back bar. A back bar is an elongate, tube-like structure concentric with the axis of rotation of the assembly. The bar has, for example, seven, eight or nine flat surfaces extending along the bar length. A bar with eight such surfaces would be octagonal in cross-section and magnets are mounted along the length of each such surface.

While the back bar is seemingly necessary, it occupies a good deal of volumetric space that could otherwise be occupied by magnet material. Until the invention, there was no way to eliminate the back bar and use the resulting space for magnets.

Eddy current separator features such as a well-protected magnet assembly, a well-protected outer shell, a structure to direct ferrous fines into a receptacle along with other waste, a conveyor belt with improved cleat arrangement, a high-mass magnet and a unique pole face for reducing air gap would be important advances in the art.

OBJECTS OF THE INVENTION

It is an object of the invention to provide an improved eddy current separator overcoming some of the problems and shortcomings of the prior art.

Another object of the invention is to provide an improved eddy current separator having a well-protected magnet assembly.

Another object of the invention is to provide an improved eddy current separator having a well-protected conveyor-belt-supporting shell.

Another object of the invention is to provide an improved eddy current separator which permits collection of ferrous fines and non-metal waste together in the same receptacle.

Yet another object of the invention is to provide an improved eddy current separator using a conveyor belt with a cleat arrangement configured particularly for use with such separators.

Another object of the invention is to provide an improved eddy current separator which uses a high-mass magnet arrangement.

Still another object of the invention is to provide an improved eddy current separator in which the magnet assembly is free of a back bar.

Another object of the invention is to provide an improved eddy current separator, the magnets of which are configured to reduce air gap. How these and other objects are accomplished will become apparent from the following descriptions and from the drawing.

SUMMARY OF THE INVENTION

The invention involves a separator for removing metal pieces from waste moved by a conveyor. Such separator includes a magnet assembly rotating at a speed and comprised of a plurality of radially-arranged magnets.

In the improvement, the magnet assembly includes a metal sleeve around the magnets and rotating at the same speed as the assembly. Such sleeve protects the magnets from impact by shrapnel-like objects which may pierce the conveyor.

More specifically, the assembly has an inner member sometimes referred to as a "back bar" which supports the magnets. The sleeve is around and generally concentric with the inner member and the sleeve and the inner member are coupled to one another by rigid spacers. Preferably, the metal sleeve is stainless steel (e.g., type 304) which is non-magnetic.

In another aspect of the invention, the separator has a shell around and spaced from the sleeve. Such shell, in engagement with and supporting the conveyor belt carrying the waste, rotates at a speed substantially less than the speed of rotation of the magnet assembly. The shell is overlaid with a wear-resistant epoxy coating for shell protection and for providing further protection to the magnet assembly. A highly-preferred coating includes a first layer on the shell and having a first color. A second layer is on the first layer and has a second color so that areas worn through the second layer are visually detectable.

The separating system has a receptacle for receiving the waste from the conveyer and from which non-ferrous metal has been substantially removed. There is a conveying extension angled from the separator toward the receptacle so that finely-divided metal particles (which otherwise have a tendency to cling to the conveyor belt and fall therefrom at a location rearward of the receptacle) are guided into the receptacle. Such conveying extension includes a downwardly-angled conveyor belt portion and a rotating drum adjacent to the receptacle. Such portion extends from the separator (specifically, from the separator shell) and contacts the rotating drum.

As a result of using the rotating drum, fuzz iron and ferrous bits passing around the shell are substantially influenced by the magnetic field of the separator over about 900 or less rather than over about 180°. This significantly diminishes the time over which the fuzz iron and bits might "auger" their way through the conveyor belt.

In another aspect of the invention, the moving conveyor belt has a plurality of spaced-apart cleats (referred to as first cleats having a first height) disposed laterally on the belt. Such cleats are found on conventional belts and the spacing between two such adjacent cleats is greater than one-half the width of the belt.

In the improvement, the belt also includes a plurality of spaced-apart lateral second cleats. The preferred spacing between two adjacent second cleats is less than one-half the width of the belt. Further, the second cleats have a second height which is substantially less than the height of the first cleats.

In another aspect of the invention, the magnet assembly is a two-pole assembly and includes a north pole member and a south pole member. Each of the pole members has an outer end and the ends define a circle when the magnet assembly is rotating. Each of the pole members has a width which is at least about 15% of the diameter of such circle and, most preferably, which is at least about 40% to 50% or more of such diameter.

In yet another aspect of the invention, the magnet assembly is free of a back bar or, at least, is substantially free of a back bar having a dimension measured along an assembly diameter coincident with the pole members which is a significant percentage of such diameter. To put it in other terms, each of the pole members has an interior portion and such interior portions are substantially coincident with the axis about which the magnet assembly rotates. In a highly preferred embodiment, the interior portions of the pole members are substantially coincident with such axis.

In yet another aspect of the invention, the pole members (irrespective of the number thereof in the assembly) include curved pole faces. When the magnet assembly is rotating, the pole faces define and are coincident with a circle. Such curved pole faces permit the "mass" of each pole member to be positioned closely adjacent to the metal pieces on the conveyor. Such positioning is closer than is possible when the pole members have flat "chord-like" faces, even though the assembly uses a relatively-large number of smaller pole members.

Other aspects of the invention are set forth in the following detailed description and in the drawings.

BRIEF DESCRIPTION OF THE DRAWING

FIG. 1 is an elevation view of a separating system incorporating the new eddy current separator. Parts are broken away.

FIG. 2 is an end elevation view of the new eddy current separator.

DETAILED DESCRIPTION OF PREFERRED EMBODIMENT

Figure 3:
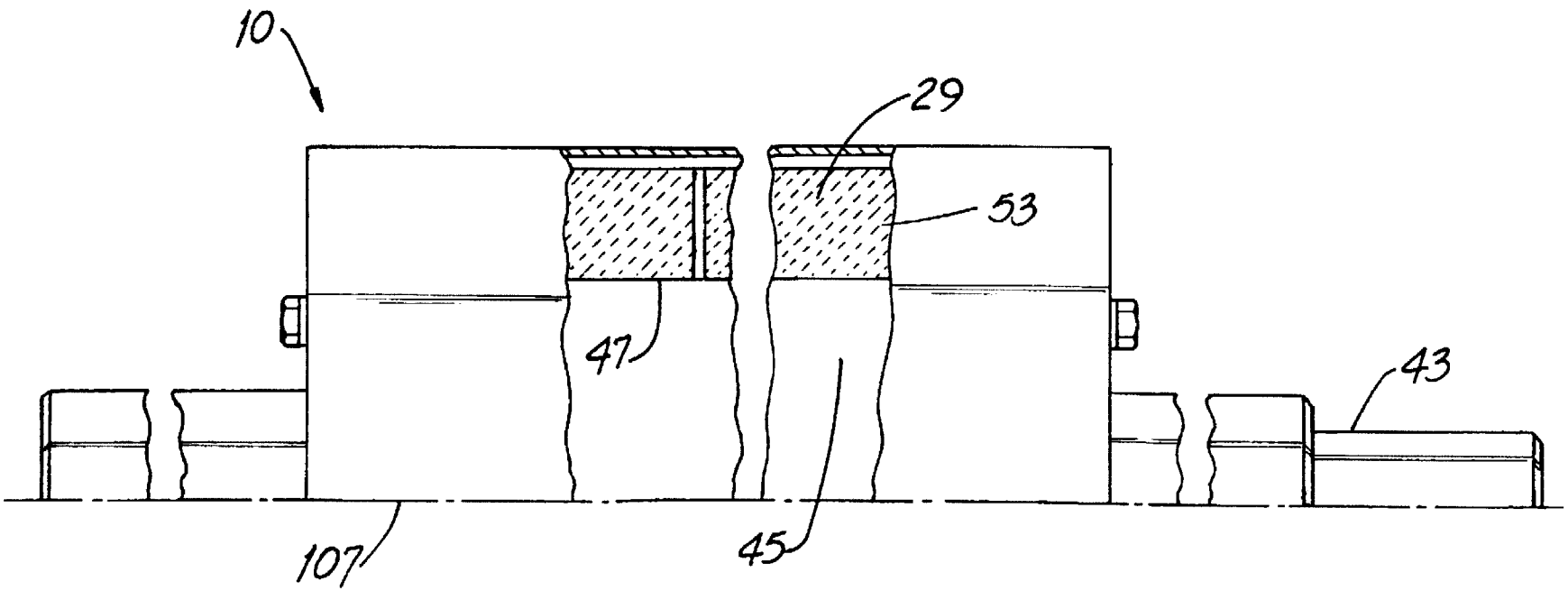
FIG. 3 is a partial section view of the separator of FIG. 2 taken along the viewing plane 3—3 thereof. Parts are broken away.
Figure 4:
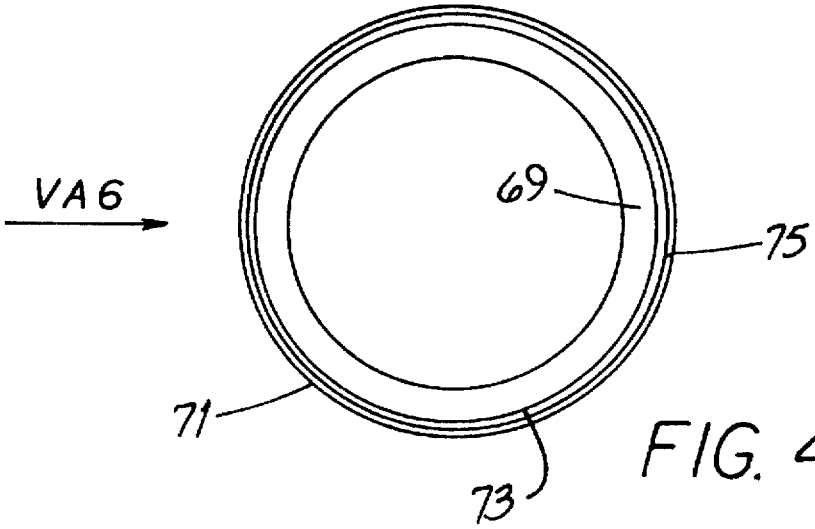
FIG. 4 is an end elevation view of a unique protective shell used with the separator of FIG. 2.
Figure 5:
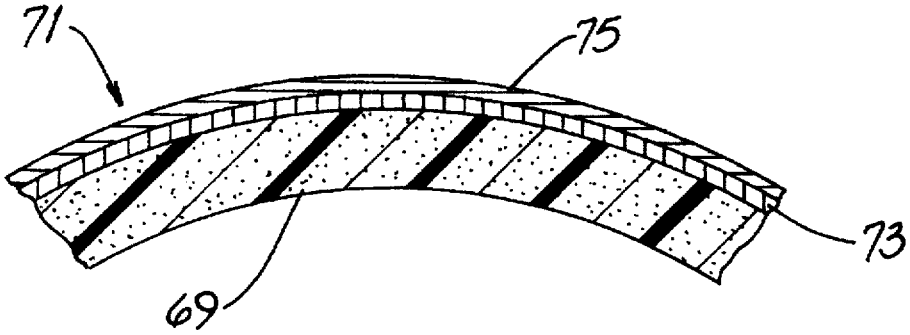
FIG. 5 is an enlarged view of an arc-like segment of the shell shown in FIG. 4.

Referring first to FIG. 1, the new eddy current separator 10 is used with a separating system 11 arranged generally as shown. Such system 11 includes a conveyor belt 13 carrying shredded "fluff 15," i.e., finely-divided fabric and upholstery components resulting from the process of shredding automobiles to recover valuable constituents thereof. The fluff 15 moving along the conveyor belt 13 has both ferrous and non-ferrous metal constituents entrained therein.

The conveyor belt 13 has a magnetic pulley 17 in contact with and supporting such belt 13. Such pulley 17 has a peripheral velocity substantially equal to the linear velocity of the conveyor belt 13. Ferrous constituents 19 entrained in the fluff 15 are attracted toward the pulley 17 and are held on the belt 13 until the belt 13 separates from the pulley 17 approximately at the region 21.

Because of such belt-pulley separation, the strength of the magnetic field holding the ferrous constituents 19 on the belt 13 diminishes rapidly to a value such that ferrous constituents 19 having significant mass can no longer be held on the belt 13. Such constituents leave the belt 13 along a generally-predictable trajectory indicated at 23.

While magnetic separators do a highly satisfactory job of removing most ferrous constituents 19 from the fluff 15, some ferrous constituents 19 inevitably remain. Types of such remaining constituents 19 found in such fluff 15 include small bits of ferrous metal having, say, a surface area of around one-quarter square inch and iron fines or "fuzz iron," as it is sometimes called. Fuzz iron is typically made up of particles about the size of a pin head or smaller.

The waste comprised of fluff 15, now substantially free of ferrous constituents 19 (except for fuzz iron and somewhat-larger ferrous bits of metal) but having non-ferrous metal pieces 31 entrained therein, is directed to a vibratory feeder 25. The feeder 25 levels out "surges" (rapid changes in the rate the fluff 15 is being introduced into the feeder 25) and helps provide a uniform feed rate to the separator 10. The vibratory feeder 25 directs the fluff 15 to a second conveyor belt 27 having the new eddy current separator 10 mounted closely adjacent thereto. (But for the new separator 10, the system 11 is generally known.)

Referring also to FIG. 2 the rapidly-spinning separator 10 (with its magnets 29) induces circulating electrical currents, i.e., eddy currents, in the non-ferrous metal pieces 31 entrained in the fluff 15. In effect, the magnets 29 temporarily transform such pieces 31 into small magnets, the magnetic fields of which exhibit polarity which is the same as that of the magnet 29 which induced the eddy current resulting in such field. Since like magnetic poles repel one another, the non-ferrous scrap metal pieces 31 are repelled and projected away from the conveyor belt 27 along a fairly-predictable trajectory (indicated at 33) to a receptacle 35 spaced somewhat away from the eddy current separator 10. The fluff 15 from which such pieces 31 have been separated is deposited into another receptacle 37.

It is noted here that fuzz iron and other bits of ferrous material tend to cling to the underside 39 of the belt 27 even though such belt 27 has become spaced away from the separator 10. One reason such fuzz iron and ferrous bits are a nuisance is that, in a conventional system 11, a separate receptacle 41 must be provided for them. And when collected in such receptacle 41, they have little or no value. Aspects of the invention include an improvement (describe below) which eliminates the receptacle 41 and separate handling of fuzz iron and ferrous bits.

Referring also to FIGS. 2 and 3, aspects of the new separator 10 will now be described. Such separator 10 includes a driven shaft 43 on which is mounted an inner member 45 having a plurality of generally-flat surfaces 47 parallel to one another and extending the length of such member 45. The member 45 is generally tubular and sometimes referred to as a "back bar."

The number of surfaces 47 on the member 45 is equal to the number of magnetic poles of the magnet assembly 49. Along each surface 47 is mounted a row of radially-extending magnets 29, preferably rare earth magnets in that they provide a very strong magnetic field per unit volume of magnetic material.

All of the magnets 29 in a particular row have the same magnetic pole face outward, i.e., the north pole face or the south pole face as denoted by the pole designators N and S in FIG. 2. And the outwardly-facing pole faces of the magnets 29 of adjacent rows are (e.g., rows 51, 53) opposite pole one to another. For example, all of the magnets 29 in the row of 53 have their south pole faces 55 outward while all of the magnets 29 in the row 51 have their north pole faces 57 outward. The magnets 29 comprising the rows 51, 53 are held in place with adhesive and the V-shaped spaces 59 between rows 51, 53 are filled with epoxy filler.

As the improvement, the assembly 49 has a generally-cylindrical metal sleeve 61 around the magnets 29 and around the inner member 45. Such sleeve 61 is generally concentric with the member 45 and the sleeve 61 and member 45 are coupled to one another by rigid spacers 63. In a particular embodiment, each of such spacers 63 includes a radially-disposed flat, web-like plate generally coextensive with the member 45 and the sleeve 61 and attached to both. The diameter of the sleeve 61 is selected so that it either just lightly touches or is spaced very slightly from the edges 65 of the pole faces 55, 57. And the sleeve 61 is preferably made of a metal, e.g., type 304 stainless steel, which is non-magnetic.

From FIGS. 2 and 3, it is to be appreciated that the magnet assembly 49 (including the inner member 45, the magnets 29 and the sleeve 61) are driven by a motor (not shown) coupled to the shaft 43. The rotational speed of the magnet assembly 49 is quite high, e.g., on the order of 1500 to 3000 revolutions per minute (RPM). The drive arrangement 67 powering the magnet assembly 49 is generally shown in FIG. 1.

Referring particularly to FIGS. 2, 4, 5 and 6, the separator 10 has a tube-like shell 69 which is concentric with the magnet assembly 49. The shell 69 is mounted on bearings separate from those supporting the shaft 43 of the magnet assembly 49. Therefore, the shell 69 can and does rotate independently of the magnet assembly 49 and at a rotational speed different from that of the assembly 49.

Figure 6:
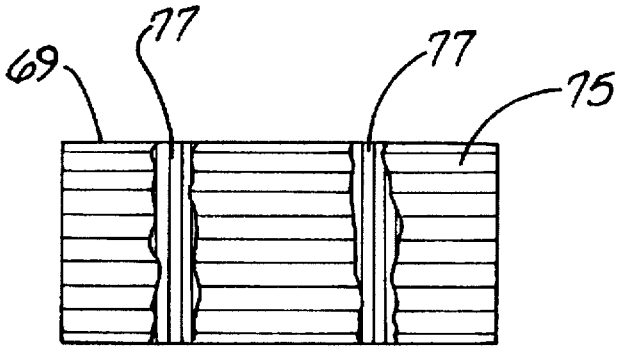
FIG. 6 is a view of the shell of FIG. 4 taken generally along the viewing axis VA6 thereof.

Such shell 69 may be made of a non-magnetic composite material such as fiberglass. The shell 69 is overlaid with a wear-resistant epoxy coating 71 for shell protection and to help prevent vagrant metal objects on the conveyor belt 27 from piercing the shell 69. Preferably, the coating 71 includes a first layer 73 on the shell 69 and a second layer 75 atop the first layer 73. The layers 73, 75 have differing colors and a red first layer 73 and blue second layer 75 are exemplary. As shown in FIG. 6, places 77 at which the second layer 75 is worn through are visually apparent by virtue of the fact that such places 77 have the color of the first layer 73.

Figure 7:
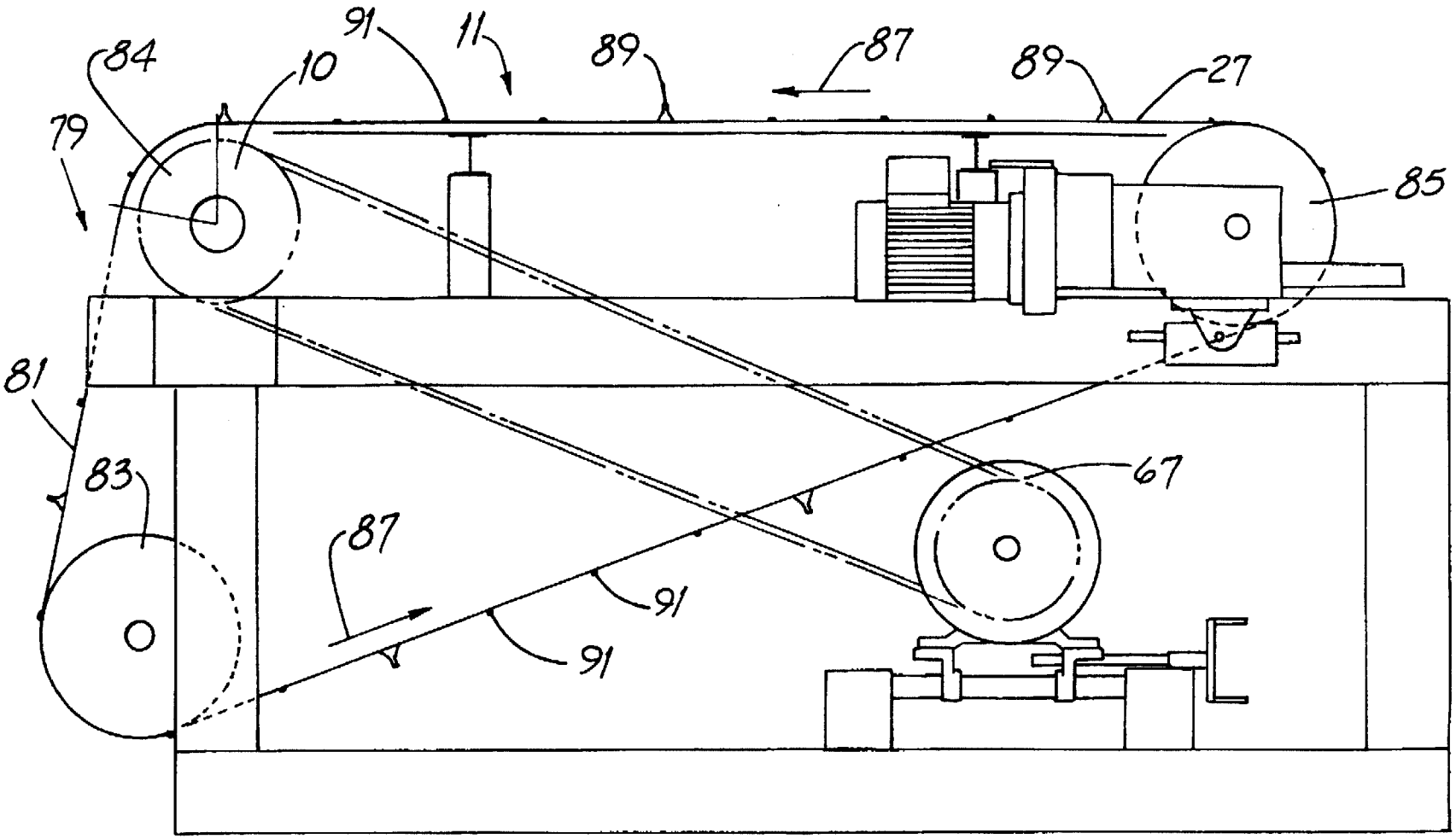
FIG. 7 is an elevation view of another embodiment of a separating system.

Referring also to FIG. 7, the improved system 11 has a conveying extension 79 angled from the separator 10 toward the receptacle 37. Finely-divided ferrous metal bits and fuzz iron (which otherwise have a tendency to cling to the conveyor belt 27 and fall therefrom into the receptacle 41, i.e., at a location rearward of the receptacle 37) are guided into the receptacle 37. Such conveying extension 79 includes a downwardly-angled conveyor belt portion 81 and a rotating drum 83 adjacent to the receptacle 37. Such portion 81 extends from the separator 10 (specifically, from the separator shell 69) and contacts the rotating drum 83.

Referring again to FIG. 1, another reason why fuzz iron and non-ferrous bits have a pronounced tendency to "drill" their way through the belt 27 is that such fuzz iron and bits are under the influence of the magnetic field of the separator 10 over about 180° of the shell 69. To put it another way, the "dwell time" of such fuzz iron and bits in the magnetic field is relatively long.

FIG. 7 illustrates how the portion 81 and drum 83 dramatically reduce such dwell time. Using the portion 81 and drum 83, the fuzz iron and ferrous bits are in and substantially influenced by the magnetic field over an arc 84 of well less than 180° and, most preferably, over an arc 84 of less than 90°.

Referring further to FIGS. 2 and 7, it is to be appreciated that the cleated conveyor belt 27 carrying fluff 15 is supported by a rear driven pulley 85, by the separator shell 69 and by the rotating drum 83. The shell 69 and the drum 83 are "free-wheeling" and rotate only because they contact the moving belt 27. The direction of belt travel is indicated by the arrows 87 and the linear velocity of the belt may be around 400 feet per minute, as an example. If the shell 69 has a diameter of 14 inches, the shell rotational speed will be about 110 RPM at a belt speed of 400 feet per minute.

In another aspect of the invention, the moving conveyor belt 27 has a plurality of spaced-apart cleats 89 (referred to as first cleats 89 having a first height) disposed laterally on the belt 27 and generally normal to the direction of belt travel. Insofar as is known, conventional belts 27 used for processing with eddy current separators include only first cleats 89, the spacing between two adjacent cleats 89 being well in excess of the width of the belt 27.

As an improvement, the belt 27 also includes a plurality of spaced-apart second cleats 91 which are also disposed laterally and generally perpendicular to the direction of belt travel. The spacing between two adjacent second cleats 91 is less than one-half the width of the belt 27. Further, the second cleats 91 have a second height which is substantially less than the first height.

Using a larger number of substantially-shorter cleats 91 than found on conveyor belts 27 conventionally used for separating helps reduce the number of finely-divided, spinning particles lodged against a particular cleat. This helps reduce the possibility that the belt 27 will be pierced by such a spinning particle and lengthens the time before such piercing occurs. And using shorter cleats 91 helps non-ferrous metal pieces 31 from being held farther away from the magnet assembly 49 as might be the case when using only relatively-tall cleats 89. The way in which fuzz iron and small bits of ferrous material pierce the belt 27 is explained below in connection with FIGS. 11 and 12.

Figure 8:
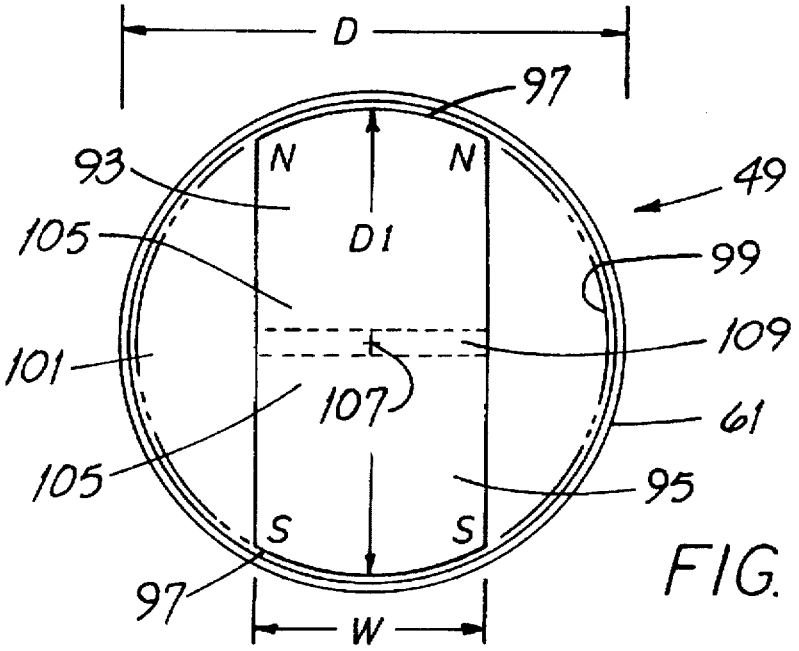
FIG. 8 is an end elevation view of another embodiment of the new eddy current separator.
Figure 9:
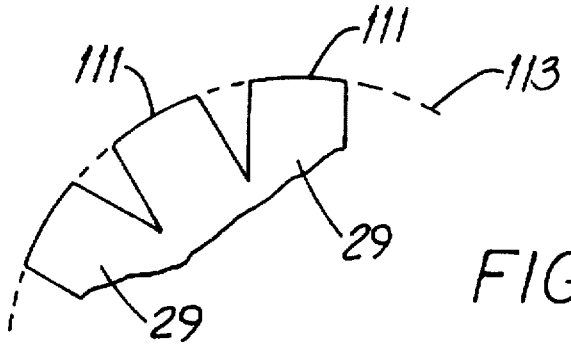
FIG. 9 is an end elevation view of yet another embodiment of the new eddy current separator.

Referring next to FIG. 8, in another aspect of the invention, the magnet assembly 49 is a two-pole assembly and includes a north pole member 93 and a south pole member 95. Each of the pole members 93, 95 has an outer end 97 and the ends 97 define a circle (represented by the dashed line 99) when the magnet assembly 49 is rotating. Each of the pole members 93, 95 has a width W which is at least about 15% of the diameter D of such circle and, most preferably, which is at least about 40% to 50% or more of such diameter.

Figure 10:
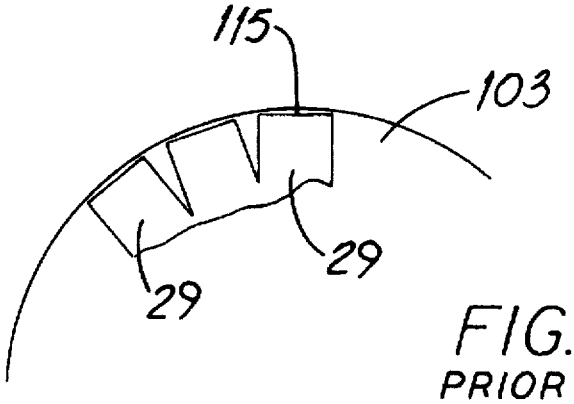
FIG. 10 PRIOR ART
FIG. 10 is an end elevation view of a prior art eddy current separator.

It is quite apparent from FIG. 8 that a good portion of the total volume of a space 101 defined by the diameter of the circle and the length of the magnet assembly 49 is filled with magnets 29. That fact is better appreciated by comparing FIG. 8 with a conventional prior art arrangement 103 as shown in FIG. 10. As a consequence, the field strength at the end of the pole members 93, 95 is very strong and "reaches into" the depth of the fluff 15 moving along the conveyor belt 27.

(The magnet assembly 49 of FIG. 8 is shown in conjunction with the desirable metal sleeve 61 described above. However, such sleeve 61 is not required in order to produce a highly satisfactory magnetic field; the sleeve 61 is for protecting the pole members 93, 95, not for enhancing the magnetic field.)

In yet another aspect of the invention, the magnet assembly 49 is free of an inner member 45 or, at least, is substantially free of an inner member 45 having a dimension (measured along an assembly diameter D1 coincident with the pole members) which is a significant percentage of such diameter D1. To put it in other terms, each of the pole members 93, 95 has an interior portion 105 which is coincident or substantially coincident with the axis 107 about which the magnet assembly 49 rotates.

Such arrangement may be constructed by mounting the pole members 93, 95 on a flat plate which, in turn, is supported by a shaft like the shaft 43. Or the end-abutting interior portions 105 of the north pole members 93 and companion south pole members 95 may be held together with adhesive and the assembly 49 clamp-mounted and supported by a shaft 43.

In yet another aspect of the invention, the magnets 29 (irrespective of the number thereof in the assembly 49) include curved pole faces 111. When the magnet assembly 49 is rotating, the pole faces 111 define and are coincident with a circle 113. Such curved pole faces 111 permit the "mass" of each magnet 29 to be positioned more closely adjacent to the sleeve 61 (if such sleeve 61 is used), to the shell 69 and to the metal pieces 31 on the conveyor belt 27. Such positioning is closer than is possible when the magnets 29 have flat "chord-like" faces 115 as in FIG. 10, even though the prior art assembly of FIG. 10 uses a relatively-large number of smaller magnets 29.

Figure 11:
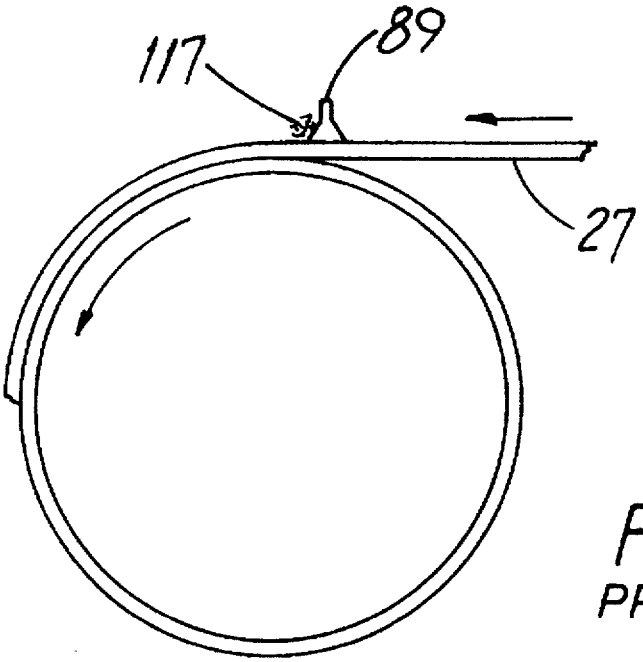
FIG. 11 PRIOR ART
FIG. 11 is an elevation view of a prior art conveyor belt and pulley showing how cleats of standard height retain metal pieces. Parts are broken away.
Figure 12:
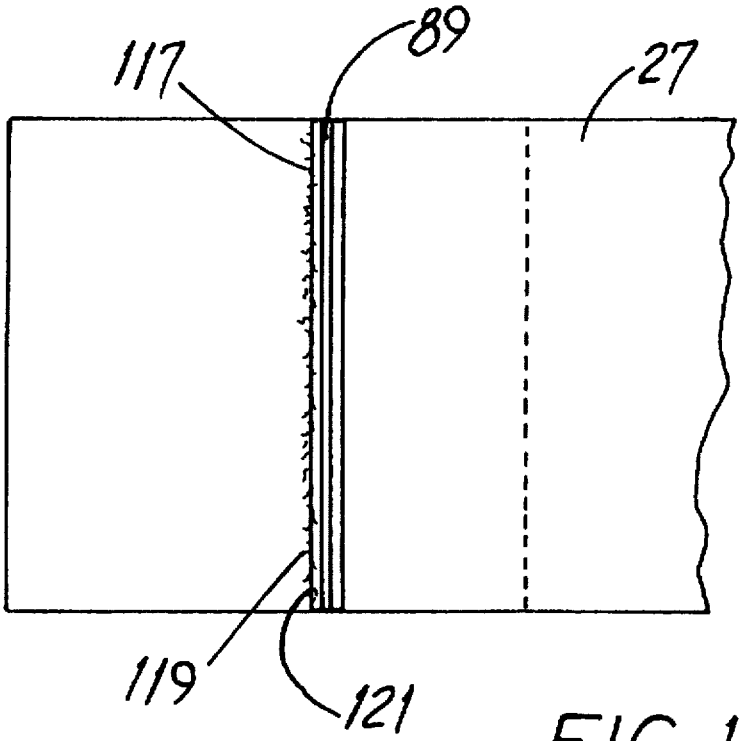
FIG. 12 PRIOR ART
FIG. 12 is a top plan view of the belt and pulley shown in FIG. 11. Parts are broken away.

The way in which fuzz iron 117 and small bits 119 of ferrous material pierce a conveyor belt 27 will be better appreciated by referring to FIGS. 11 and 12. Such conveyor belt 27 has a cleat 89 and the fuzz iron 117 and ferrous bits 119 often lodge at the junction 121 of the cleat 89 and the belt 27. The rapidly-spinning magnet assembly 49 causes such iron 117 and bits 119 to spin at a high rate of speed.

It is not too much of an exaggeration to say that the effect of such spinning iron 117 and bits 119 is like that of a dentist's drill. The iron 117 and bits 119 pierce pinholes in the belt 27 and contact the shell 69. Often, such iron 117 and bits 119 lodge between the belt 27 and the shell 69 and continue to spin. Over some period of separator operating time, it is not particularly uncommon to have a shell severed circumferentially by such spinning, cutting action of the iron and bits. FIG. 6 illustrates how the outer surface of the shell 69 can be worn away by the iron 117 and bits 119.

And that is not the only damage that can occur nor is it the most serious. Fuzz iron 117, bits 119 and larger ferrous pieces may penetrate the shell 69 and strike the magnet assembly 49 with projectile-like force, cracking or shattering a magnet 29 on the assembly 49. The value of such assembly 49 may be over 50% of the value of the separator 10 and quite aside from replacement cost, the downtime of the system 11 is very expensive.

While the principles of the invention have been shown in connection with a few preferred embodiments, it is to be understood clearly that such embodiments are exemplary and not limiting.

What is claimed is:

1. In a separator for removing metal pieces from waste moved by a conveyor, the separator including a magnet assembly rotating at a speed and comprised of a plurality of radially-arranged magnets, the improvement wherein:

the separator includes a conveyor belt supported by a shell;

the magnet assembly is in the shell and rotates on a shaft;

the magnet assembly includes a metal sleeve around the magnets wherein the metal sleeve is positioned between the shaft and the shell, whereby the magnets are protected from impact by objects piercing the conveyor.

2. The separator of claim 1 including an inner member supporting the magnets and wherein:

the sleeve is around and generally concentric with the inner member; and the sleeve and the inner member are coupled to one another by rigid spacers.

3. The separator of claim 1 wherein the sleeve is non-magnetic.

4. The separator of claim 2 wherein the sleeve is made of stainless steel.

5. The separator of claim 1 wherein:

the shell rotates at a speed substantially less than the speed of rotation of the magnet assembly;

the shell is overlaid with an epoxy coating for shell protection;

the coating includes a first layer on the shell and having a first color and a second layer of the first layer and having a second color, whereby circumferential areas worn through the second layer are visually detectable.

6. The separator of claim 1 in combination with the conveyor and a receptacle for receiving the waste from the conveyer and wherein:

the waste contains very small ferrous bits;

the combination includes a conveying extension having a belt portion angled forwardly from the shell toward the receptacle; and the ferrous bits are substantially influenced by the magnet assembly over an arc significantly less than 180°, whereby finely-divided metal particles are guided into the receptacle and conveyor belt wear is reduced.

7. The combination of claim 6 wherein:

the conveying extension includes a rotating drum forward of the shell.

8. The separator of claim 1 in combination with the conveyor and wherein the conveyor includes a moving belt having a width and a plurality of spaced-apart first cleats and wherein:

the belt includes a plurality of spaced-apart second cleats; and the spacing between two adjacent second cleats is less than one-half the width of the belt.

9. The combination of claim 8 wherein:

the spacing between two adjacent first cleats is greater than one-half the width of the belt.

10. The combination of claim 9 wherein:

the first cleats have a first height;

the second cleats have a second height which is substantially less than the first height.

11. In a separator for removing metal pieces from waste moved by a conveyor, the separator including a magnet assembly rotating at a speed and comprised of a plurality of radially-arranged magnets, the improvement wherein:

the magnet assembly includes (a) an inner member supporting the magnets, and (b) a metal sleeve around the magnets and rotating at the speed;

the sleeve is around and generally concentric with the inner member; and the sleeve and the inner member are coupled to one another by rigid spacers.

12. The separator of claim 11 in combination with the conveyor and wherein the conveyor includes a moving belt having a width and a plurality of spaced-apart first cleats and wherein:

the belt includes a plurality of spaced-apart second cleats; and the spacing between two adjacent second cleats is less than one-half the width of the belt.

13. The combination of claim 12 wherein:

the spacing between two adjacent first cleats is greater than one-half the width of the belt.

14. The combination of claim 13 wherein:

the first cleats have a first height;

the second cleats have a second height which is substantially less than the first height.

15. The combination of claim 12 in further combination with a receptacle for receiving the waste from the conveyer and wherein:

the belt is supported by a generally-cylindrical shell; and the belt defines an arc around the shell which is less than 90°.

* * * * *

UNITED STATES PATENT AND TRADEMARK OFFICE

CERTIFICATE OF CORRECTION

PATENT NO. : 5,626,233

DATED : May 6, 19997

INVENTOR(S) : Rano R. Wells, II

It is certified that error appears in the above-identified patent and that said Letters Patent is hereby corrected as shown below:

In column 1, line 21, after "fabric" being a new paragraph with "After".

In column 4, line 40, delete "900" and insert –90°–.

Signed and Sealed this

Twenty-sixth Day of August, 1997

*Attest:*

*Attesting Officer*

Bruce Lehman

BRUCE LEHMAN

*Commissioner of Patents and Trademarks*